US010729248B2

(12) United States Patent
Tsai

(10) Patent No.: US 10,729,248 B2
(45) Date of Patent: Aug. 4, 2020

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC. (TW)

( * ) Notice: Subject to any disclaimer, the term of this patent is extended or adjusted under 35 U.S.C. 154(b) by 71 days.

(21) Appl. No.: 16/268,743

(22) Filed: Feb. 6, 2019

(65) Prior Publication Data

US 2020/0205571 A1 Jul. 2, 2020

(30) Foreign Application Priority Data

Dec. 27, 2018 (TW) ..... 107147417 A

(51) Int. Cl.

| | |
|---|---|
| ***A47C 4/28*** | (2006.01) |
| ***A47C 7/62*** | (2006.01) |
| ***A47C 7/70*** | (2006.01) |

(52) U.S. Cl.

CPC ..... *A47C 4/286* (2013.01); *A47C 7/624* (2018.08); *A47C 7/70* (2013.01)

(58) Field of Classification Search

None

See application file for complete search history.

(56) References Cited

U.S. PATENT DOCUMENTS

| | | | | |
|---|---|---|---|---|
| 2,780,506 | A * | 2/1957 | Howe | A47B 3/14 108/169 |
| 3,144,841 | A * | 8/1964 | Meringoff | A47B 25/003 108/36 |
| 3,833,256 | A * | 9/1974 | Dehner | A61G 5/08 297/44 |
| 4,243,263 | A * | 1/1981 | Thiboutot | A47C 4/286 297/42 |
| 4,245,849 | A * | 1/1981 | Thiboutot | A47C 4/286 248/436 |
| 5,058,950 | A * | 10/1991 | Mann | A47C 4/286 297/16.2 |
| 2011/0169304 | A1* | 7/2011 | Chen | A47C 4/283 297/35 |
| 2018/0140098 | A1* | 5/2018 | Lv | A47C 4/283 |

* cited by examiner

*Primary Examiner* — David E Allred
(74) *Attorney, Agent, or Firm* — Schmeiser, Olsen & Watts, LLP

(57) ABSTRACT

A folding chair includes left and right support portions, left and right load-bearing portions, left and right handrail portions, left and right back rest portions, left and right front rotating portions, left and right rear rotating portions, left and right front cross portions, left and right rear cross portions, left and right engaging portions, a seat cushion portion, and a back rest portion. The lower parts of the left and right engaging portions are pivotally connected at a pivotal connection point to form an included angle greater than 180 degrees. The upper parts of the left and right engaging portions are close to each other. The folding chair is not only unfolded and thus unchangeable in shape, but also starts to fold up, because of the left and right engaging portions.

10 Claims, 13 Drawing Sheets

FOLDING CHAIR

CROSS-REFERENCE TO RELATED APPLICATION

This non-provisional application claims priority under 35 U.S.C. § 119(a) on Patent Application No(s). 107147417 filed in Taiwan, R.O.C. on Dec. 27, 2018, the entire contents of which are hereby incorporated by reference.

FIELD OF THE INVENTION

The present disclosure relates to folding chairs and, more particularly, to a folding chair not only capable of being unfolded and thus unchangeable in shape but also capable of starting to fold up, because the folding chair has a left engaging portion and a right engaging portion.

BACKGROUND OF THE INVENTION

When unfolded, a conventional folding chair requires several points of fixation in order to remain unchanged in shape. To star folding up the conventional folding chair, a user has to unfasten the points of fixation. Therefore, it is imperative to provide a folding chair not only capable of being unfolded and thus unchangeable in shape but also capable of starting to fold up, because the folding chair has a left engaging portion and a right engaging portion.

SUMMARY OF THE INVENTION

In view of the aforesaid drawbacks of the prior art, it is an objective of the present disclosure to provide a folding chair not only capable of being unfolded and thus unchangeable in shape but also capable of starting to fold up, because the folding chair has a left engaging portion and a right engaging portion.

The present disclosure provides a folding chair comprising a left support portion, a right support portion, a left load-bearing portion, a right load-bearing portion, a left handrail portion, a right handrail portion, a left back rest portion, a right back rest portion, a left front rotating portion, a right front rotating portion, a left rear rotating portion, a right rear rotating portion, a left front cross portion, a right front cross portion, a left rear cross portion, a right rear cross portion, a left engaging portion, a right engaging portion, a seat cushion portion and a back rest portion, wherein the left handrail portion is pivotally connected to the left support portion, with the left load-bearing portion disposed between the left handrail portion and the left support portion, the left back rest portion being pivotally connected to the left handrail portion, the right handrail portion being pivotally connected to the right support portion, the right load-bearing portion being disposed between the right handrail portion and the right support portion, the right back rest portion being pivotally connected to the right handrail portion, the left front rotating portion having an end pivotally connected to an end of the right front rotating portion, the left front rotating portion having another end pivotally connected to a front side of the left support portion, the right front rotating portion having another end pivotally connected to a front side of the right support portion, the left rear rotating portion having an end pivotally connected to an end of the right rear rotating portion, the left rear rotating portion having another end pivotally connected to a rear side of the left support portion, the right rear rotating portion having another end pivotally connected to a rear side of the right support portion, the left front cross portion having an end pivotally connected to the left load-bearing portion, the left front cross portion having another end pivotally connected between two ends of the right front rotating portion, the right front cross portion having an end pivotally connected to the right load-bearing portion, the right front cross portion having another end pivotally connected between two ends of the left front rotating portion, the left rear cross portion having an end pivotally connected to the left load-bearing portion, the left rear cross portion having another end pivotally connected between two ends of the right rear rotating portion, the right rear cross portion having an end pivotally connected to the right load-bearing portion, the right rear cross portion having another end pivotally connected between two ends of the left rear rotating portion, wherein a lower part of a side of the left engaging portion and a lower part of a side of the right engaging portion are pivotally connected to each other at a pivotal connection point to form an included angle greater than 180 degrees, wherein the upper part of the side of the left engaging portion and the upper part of the side of the right engaging portion are close to each other, the left engaging portion being pivotally connected between two ends of the left front cross portion and between two ends of the left rear cross portion, the right engaging portion being pivotally connected between two ends of the right front cross portion and between two ends of the right rear cross portion, the seat cushion portion being disposed between the left load-bearing portion and the right load-bearing portion, the back rest portion being disposed between the left back rest portion and the right back rest portion.

In an embodiment, disposed between another end of the left front rotating portion and a front side of the left support portion and between another end of the right front rotating portion and a front side of the right support portion are two first torsional resilient components, respectively, to exert a downward moment of force on the pivotal connection point between the left front rotating portion and the right front rotating portion.

In an embodiment, disposed between another end of the left rear rotating portion and a rear side of the left support portion and between another end of the right rear rotating portion and a rear side of the right support portion are two second torsional resilient components, respectively, to exert a downward moment of force on the pivotal connection point between the left rear rotating portion and the right rear rotating portion.

In an embodiment, a left front leg pad is disposed on a front of a bottom of the left support portion, a right front leg pad is disposed on a front of a bottom of the right support portion, a left rear leg pad is disposed on a rear of a bottom of the left support portion, and a right rear leg pad is disposed on a rear of a bottom of the right support portion.

In an embodiment, the left support portion, the right support portion, the left handrail portion and the right handrail portion are each U-shaped, a left front pivotal connection element is disposed between a front end of the left support portion and a front end of the left handrail portion, a left rear pivotal connection element is disposed between a rear end of the left support portion and a rear end of the left handrail portion, two ends of the left handrail portion are pivotally connected to a pivotal connection slot of the left front pivotal connection element and a pivotal connection slot of the left rear pivotal connection element, respectively, the left load-bearing portion is disposed between the left front pivotal connection element and the left rear pivotal connection element, a right front pivotal connection element is disposed between a front end of the right support portion and a front end of the right handrail portion, a right rear pivotal connection element is disposed between a rear end of the right support portion and a rear end of the right handrail portion, two ends of the right handrail portion are pivotally connected to a pivotal connection slot of the right front pivotal connection element and a pivotal connection slot of the right rear pivotal connection element, respectively, and the right load-bearing portion is disposed between the right front pivotal connection element and the right rear pivotal connection element.

In an embodiment, the left back rest portion has a left arcuate connecting rod so as to be pivotally connected to the rear side of the left handrail portion, and the right back rest portion has a right arcuate connecting rod so as to be pivotally connected to the rear side of the right handrail portion.

In an embodiment, the left engaging portion and the right engaging portion are each U-shaped, lower parts of two ends of the left engaging portion and lower parts of two ends of the right engaging portion are pivotally connected to each other, respectively, at the pivotal connection point to form an included angle greater than 180 degrees, upper parts of two ends of the left engaging portion and upper parts of two ends of the right engaging portion are close to each other, respectively.

In an embodiment, the folding chair further comprises a carrying portion, the carrying portion having a carrying platform, at least a third torsional resilient component and at least a connecting rod, the carrying platform being pivotally connected to the right load-bearing portion, the third torsional resilient component being disposed between the carrying platform and the right load-bearing portion to exert an upward moment of force on the carrying platform, and the connecting rod being connected between the carrying platform and the right engaging portion.

In an embodiment, the carrying platform has a carrying recess.

In an embodiment, the seat cushion portion and the back rest portion are connected.

Therefore, the folding chair of the present disclosure is not only capable of being unfolded and thus unchangeable in shape but also capable of starting to fold up, because of the left engaging portion and the right engaging portion.

DETAILED DESCRIPTION OF THE PREFERRED EMBODIMENTS

Figure 1:
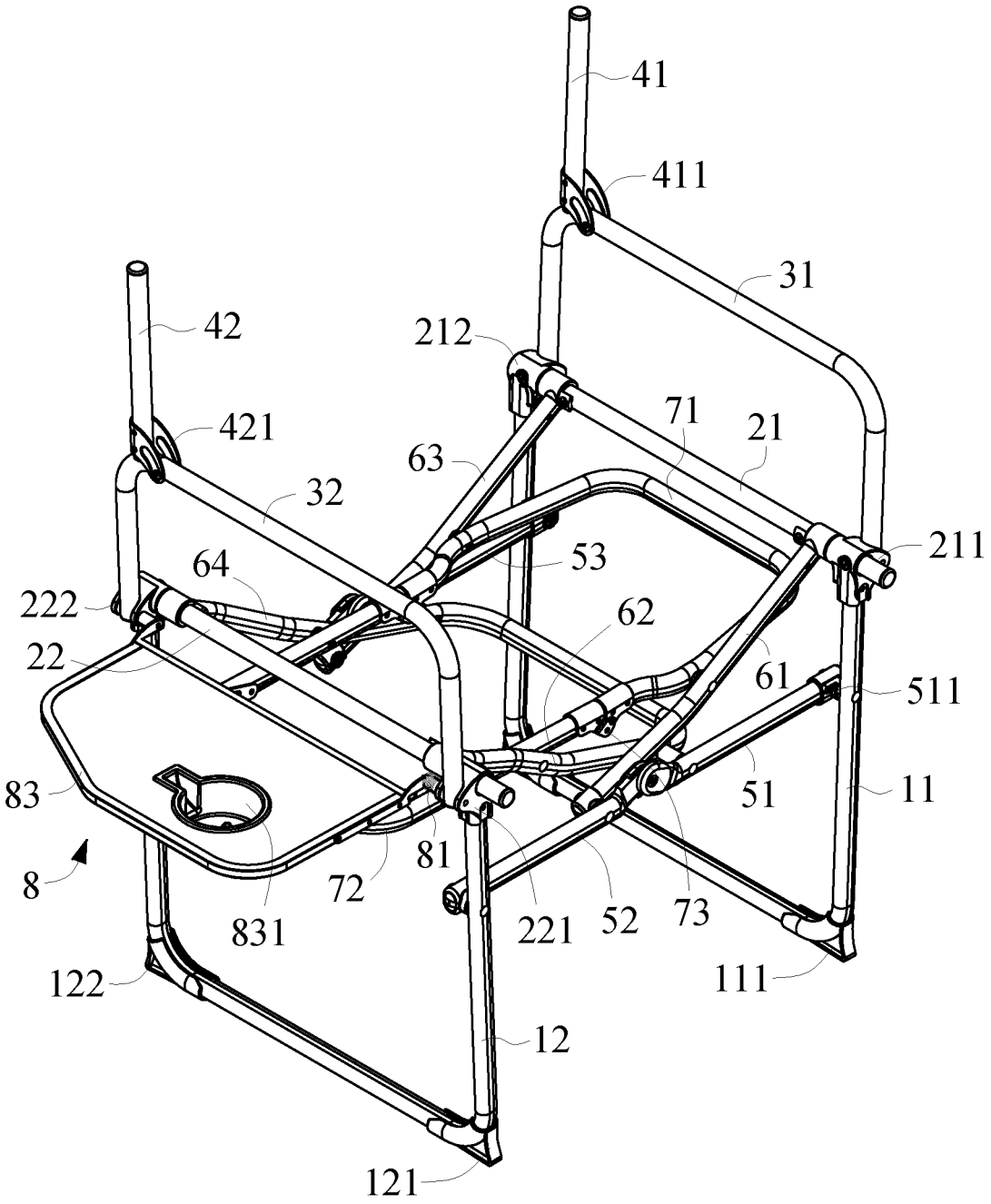
FIG. 1 is a schematic view 1 of a folding chair, without a seat cushion portion and a back rest portion, unfolded according to a specific embodiment of the present disclosure.

Objectives, features, and advantages of the present disclosure are hereunder illustrated with specific embodiments, depicted with drawings, and described below.

Referring to FIG. 1 through FIG. 7, the present disclosure provides a folding chair comprising a left support portion 11 (which is a U-shaped rod), a right support portion 12 (which is a U-shaped rod), a left load-bearing portion 21 (which is a rod), a right load-bearing portion 22 (which is a rod), a left handrail portion 31 (which is a U-shaped rod), a right handrail portion 32 (which is a U-shaped rod), a left back rest portion 41 (which is a rod), a right back rest portion 42 (which is a rod), a left front rotating portion 51 (which is a rod), a 52 right front rotating portion (which is a rod), a 53 left rear rotating portion (which is a rod), a 54 right rear rotating portion (which is a rod), a 61 left front cross portion (which is a rod), a right 62 front cross portion (which is a rod), a left rear cross portion 63 (which is a rod), a right rear cross portion 64 (which is a rod), a left engaging portion 71 (which is a U-shaped rod), a right engaging portion 72 (which is a U-shaped rod), a seat cushion portion 91 and a back rest portion 92.

The lower part of the left handrail portion 31 is pivotally connected to the upper part of the left support portion 11. The left load-bearing portion 21 is disposed between the lower part of the left handrail portion 31 and the upper part of the left support portion 11. The lower part of the left back rest portion 41 is pivotally connected to the rear of the upper part of the left handrail portion 31. The lower part of the right handrail portion 32 is pivotally connected to the upper part of the right support portion 12. The right load-bearing portion 22 is disposed between the lower part of the right handrail portion 32 and the upper part of the right support portion 12. The lower part of the right back rest portion 42 is pivotally connected to the rear of the upper part of the right handrail portion 32. One end of the left front rotating portion 51 is pivotally connected to one end of the right front rotating portion 52. The other end of the left front rotating portion 51 is pivotally connected between the upper and lower parts of the left support portion 11 from the front. The other end of the right front rotating portion 52 is pivotally connected between the upper and lower parts of the right support portion 12 from the front. One end of the left rear rotating portion 53 is pivotally connected to one end of the right rear rotating portion 54. The other end of the left rear rotating portion 53 is pivotally connected between the upper and lower parts of the left support portion 11 from behind. The other end of the right rear rotating portion 54 is pivotally connected between the upper and lower parts of the right support portion 12 from behind. One end of the left front cross portion 61 is pivotally connected to the front part of the left load-bearing portion 21. The other end of the left front cross portion 61 is pivotally connected between two ends of the right front rotating portion 52. One end of the right front cross portion 62 is pivotally connected to the front part of the right load-bearing portion 22. The other end of the right front cross portion 62 is pivotally connected between two ends of the left front rotating portion 51. One end of the left rear cross portion 63 is pivotally connected to the rear part of the left load-bearing portion 21. The other end of the left rear cross portion 63 is pivotally connected between two ends of the right rear rotating portion 54. One end of the right rear cross portion 64 is pivotally connected to the rear part of the right load-bearing portion 22. The other end of the right rear cross portion 64 is pivotally connected between two ends of the left rear rotating portion 53. The lower part of one side of the left engaging portion 71 and the lower part of one side of the right engaging portion 72 are pivotally connected to each other at a pivotal connection point 73 to form an included angle greater than 180 degrees. The upper part of the side of the left engaging portion 71 and the upper part of the side of the right engaging portion 72 are close to each other. The central part of the side of the left engaging portion 71 and the central part of the side of the right engaging portion 72 are spaced apart from each other. The left engaging portion 71 is pivotally connected between two ends of the left front cross portion 61 and between two ends of the left rear cross portion 63. The right engaging portion 72 is pivotally connected between two ends of the right front cross portion 62 and between two ends of the right rear cross portion 64. The seat cushion portion 91 is disposed between the left load-bearing portion 21 and the right load-bearing portion 22. The back rest portion 92 is disposed between the left back rest portion 41 and the right back rest portion 42. The seat cushion portion 91 and the back rest portion 92 are made of a soft material, such as fabric or plastic.

Referring to FIG. 1 through FIG. 7, under gravity, when the folding chair of the present disclosure is unfolded, the pivotal connection point between the left front rotating portion 51 and the right front cross portion 62, the pivotal connection point between the right front rotating portion 52 and the left front cross portion 61, the pivotal connection point between the left rear rotating portion 53 and the right rear cross portion 64, and the pivotal connection point between the right rear rotating portion 54 and the left rear cross portion 63 are each subjected to a downward moment of force. Therefore, two pivotal connection points between the left engaging portion 71 and the left front cross portion 61 and between the left engaging portion 71 and the left rear cross portion 63, respectively, are each subjected to an upward moment of force. Similarly, two pivotal connection points between the right engaging portion 72 and the right front cross portion 62 and between the right engaging portion 72 and the right rear cross portion 64, respectively, are each subjected to an upward moment of force. Therefore, the lower part of the side of the left engaging portion 71 and the lower part of the side of the right engaging portion 72 are pivotally connected to each other at the pivotal connection point 73 to form an included angle greater than 180 degrees, whereas the upper part of the side of the left engaging portion 71 and the upper part of the side of the right engaging portion 72 are close to each other. Therefore, when unfolded, the folding chair of the present disclosure is unchangeable in shape because of the left engaging portion 71 and the right engaging portion 72.

Referring to FIG. 8 through FIG. 12, the diagrams do not show the seat cushion portion and the back rest portion, so as to illustrate how to fold up the folding chair of the present disclosure. To fold up the folding chair of the present disclosure, a user presses the outer side of the left engaging portion 71 or the outer side of the right engaging portion 72 such that the included angle between the lower part of the side of the left engaging portion 71 and the lower part of the side of the right engaging portion 72 is less than 180 degrees, so as to draw the left support portion 11 and the right support portion 12 close to each other, draw the left load-bearing portion 21 and the right load-bearing portion 22 close to each other, draw the left handrail portion 31 and the right handrail portion 32 close to each other, draw the left back rest portion 41 and the right back rest portion 42 close to each other, draw the left front rotating portion 51 and the right front rotating portion 52 close to each other, draw the left rear rotating portion 53 and the right rear rotating portion 54 close to each other, draw the left front cross portion 61 and the right front cross portion 62 close to each other, draw the left rear cross portion 63 and the right rear cross portion 64 close to each other, and draw the left engaging portion 71 and the right engaging portion 72 close to each other. Afterward, the user stacks the left back rest portion 41 on the left handrail portion 31, stacks the right back rest portion 42 on the right handrail portion 32, stacks the left handrail portion 31 on the left support portion 11, and stacks the right handrail portion 32 on the right support portion 12, thereby folding up the folding chair of the present disclosure fully. Therefore, the folding chair of the present disclosure starts to fold up because of the left engaging portion 71 and the right engaging portion 72.

Figure 2:
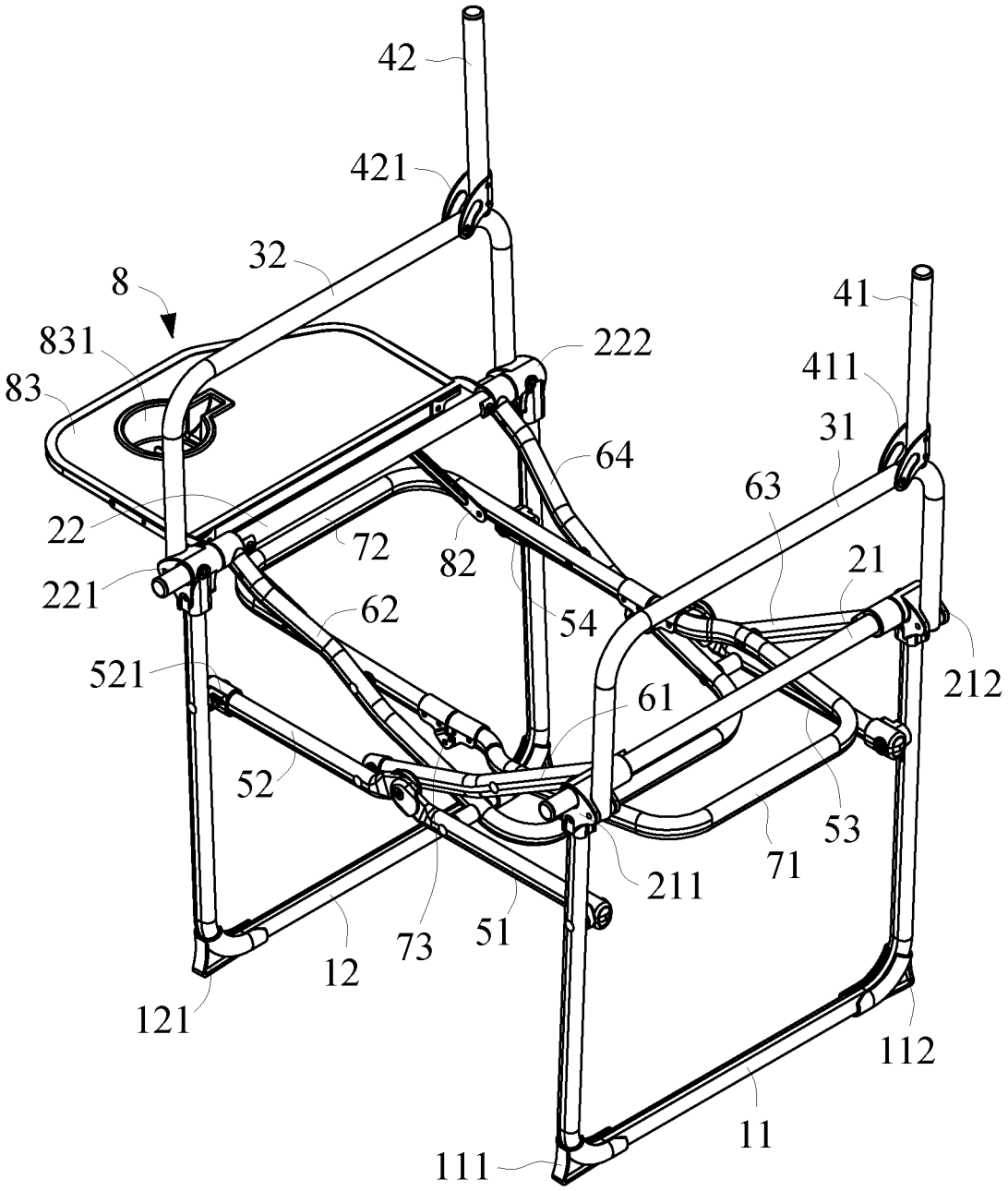
FIG. 2 is a schematic view 2 of the folding chair, without the seat cushion portion and the back rest portion, unfolded according to a specific embodiment of the present disclosure.
Figure 3:
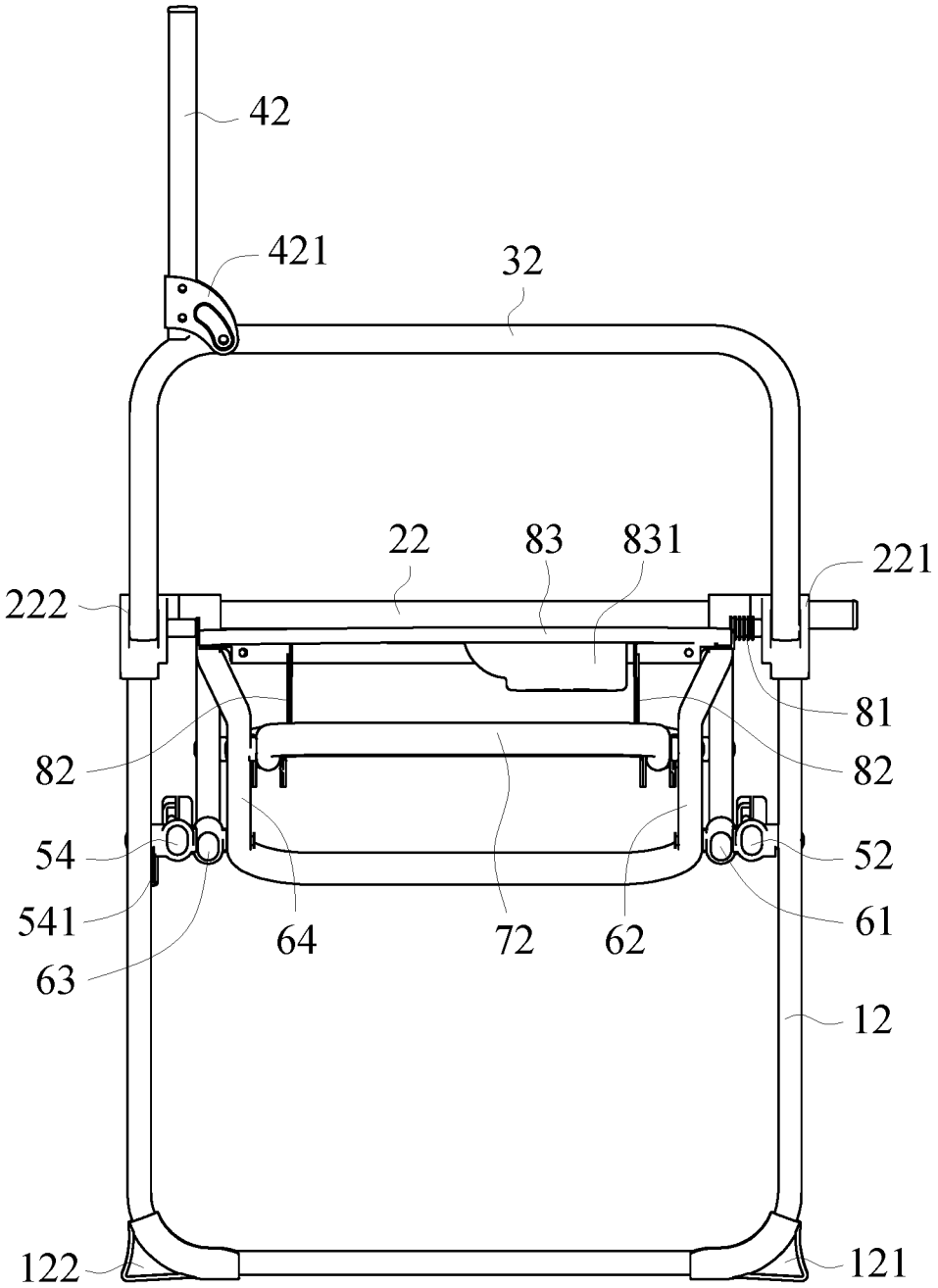
FIG. 3 is a right lateral schematic view of the folding chair without the seat cushion portion and the back rest portion according to a specific embodiment of the present disclosure.
Figure 4:
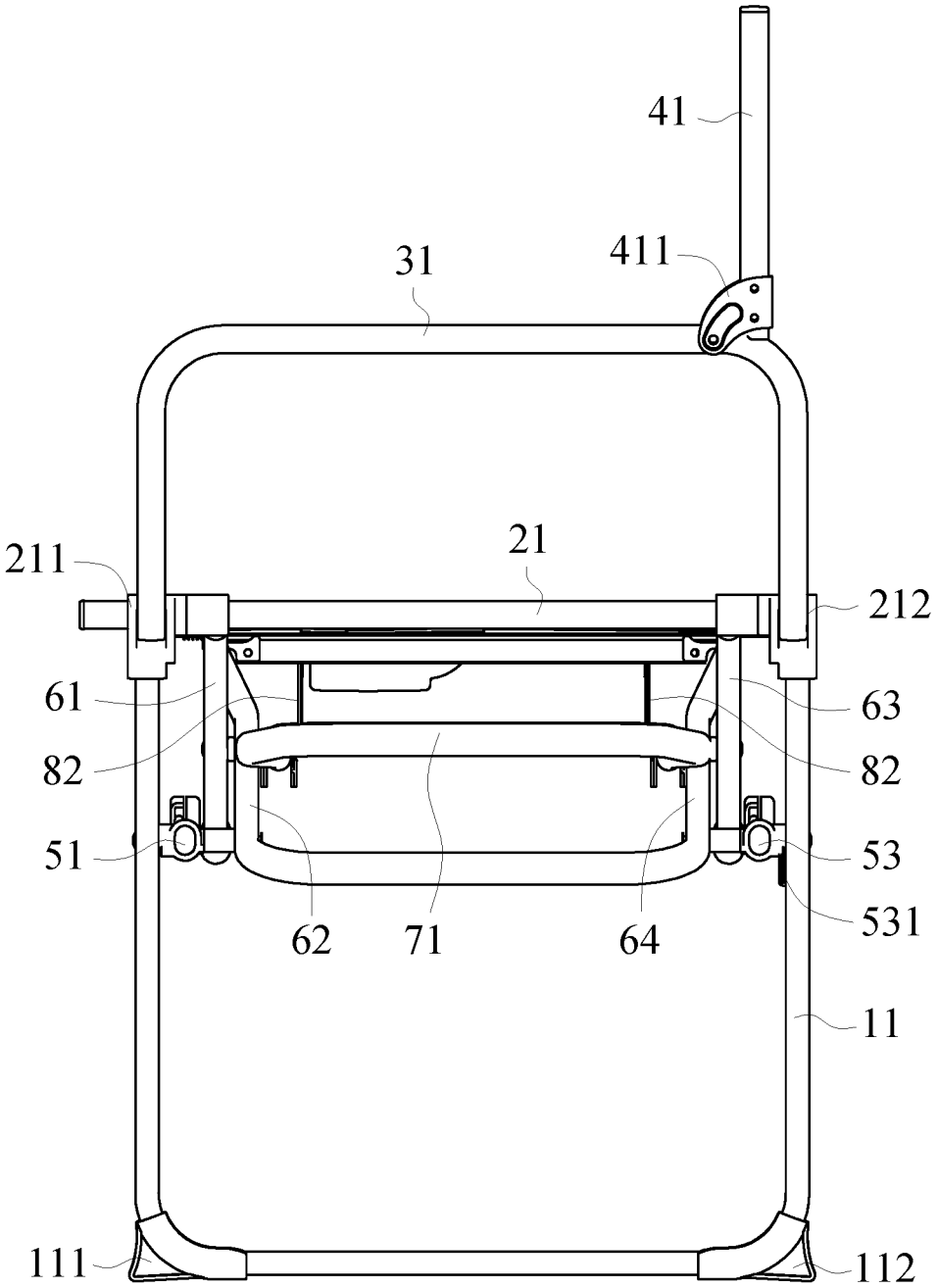
FIG. 4 is a left lateral schematic view of the folding chair without the seat cushion portion and the back rest portion according to a specific embodiment of the present disclosure.
Figure 5:
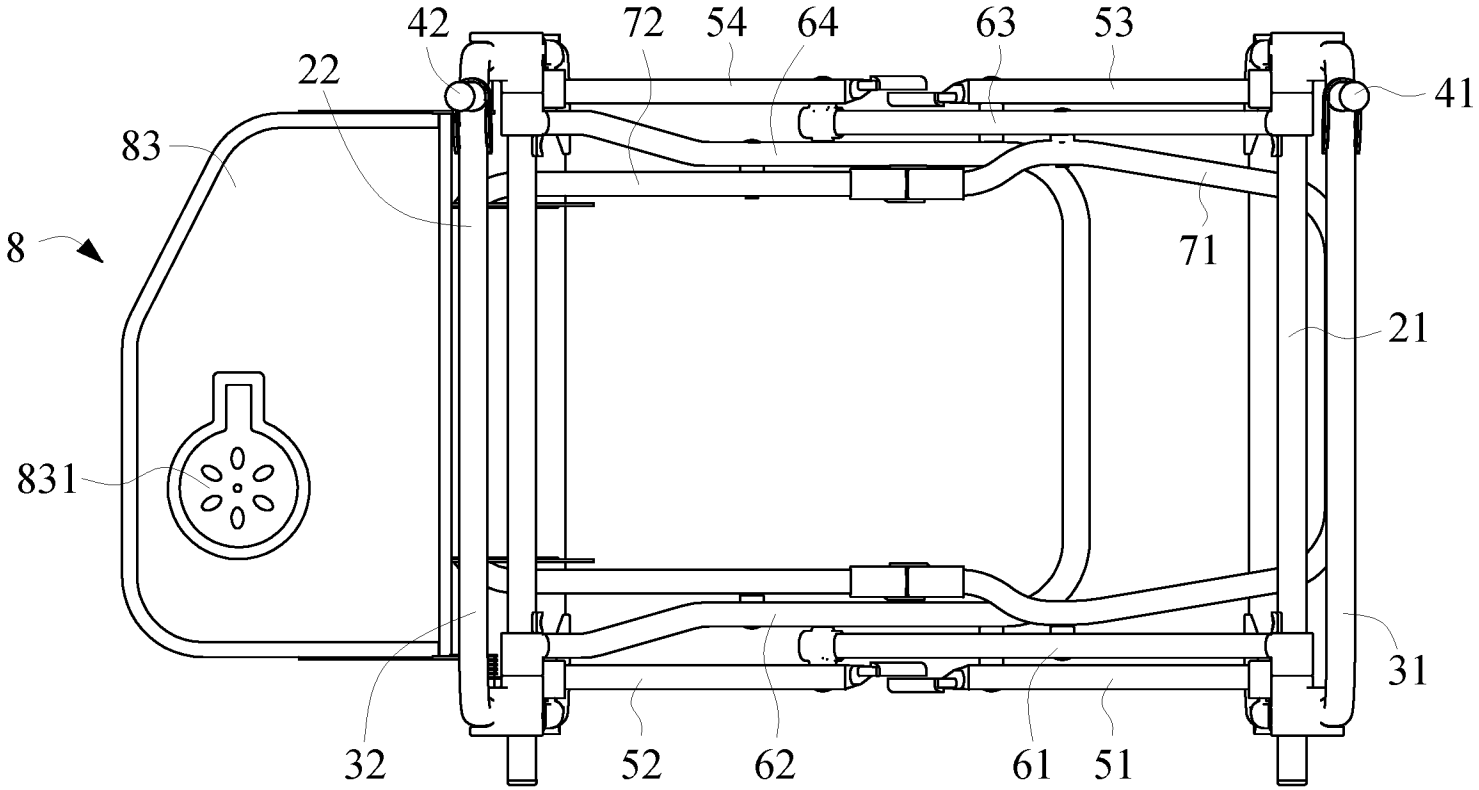
FIG. 5 is a top schematic view of the folding chair without the seat cushion portion and the back rest portion according to a specific embodiment of the present disclosure.
Figure 6:
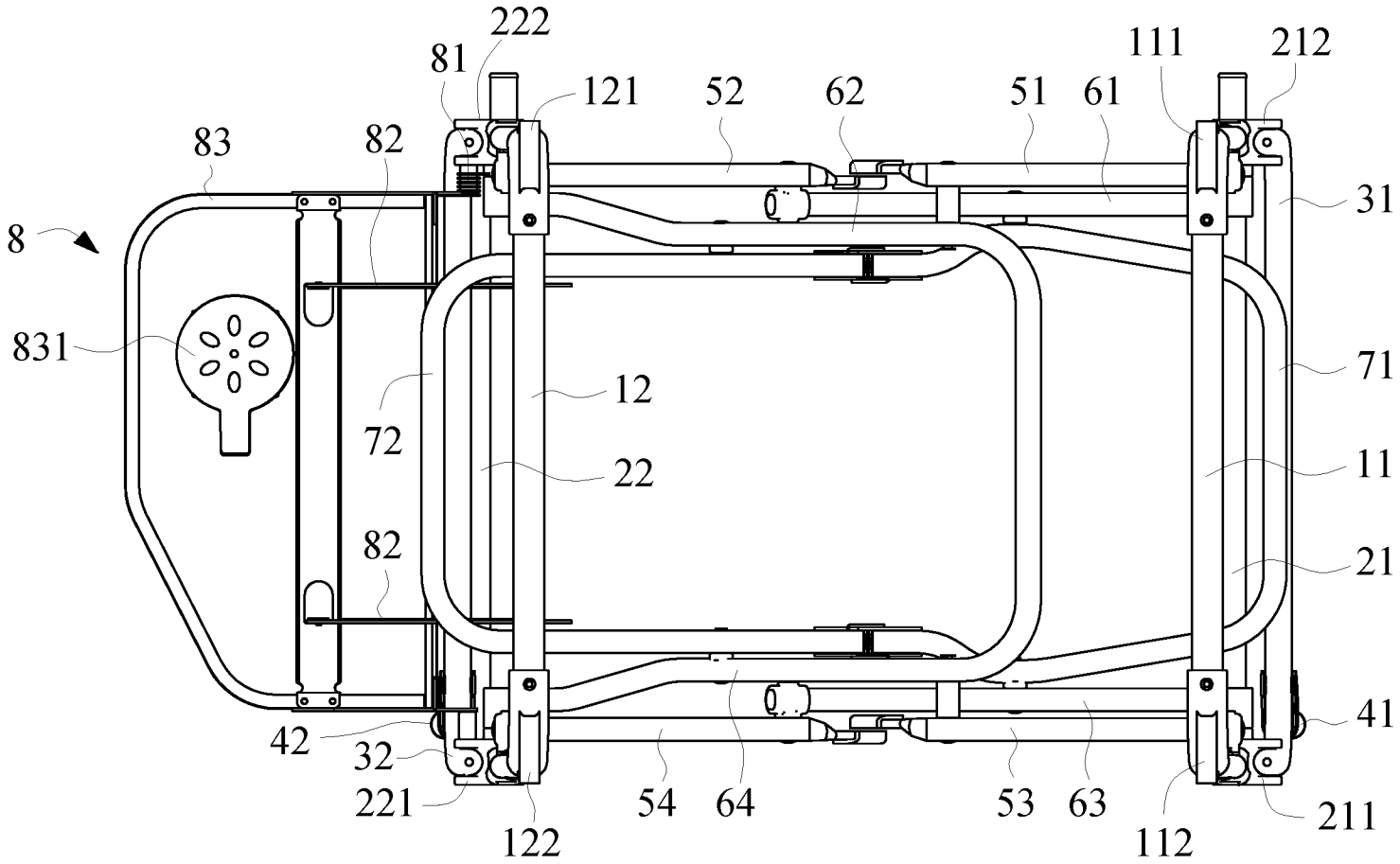
FIG. 6 is a bottom schematic view of the folding chair without the seat cushion portion and the back rest portion according to a specific embodiment of the present disclosure.

Referring to FIG. 1 and FIG. 2, in an embodiment, disposed between the other end of the left front rotating portion 51 and the upper and lower parts of the front side of the left support portion 11 and between the other end of the right front rotating portion 52 and the upper and lower parts of the front of the right support portion 12 are first torsional resilient components 511, 521 (which are torsional springs), respectively, for exerting a downward moment of force on the pivotal connection point between the left front rotating portion 51 and the right front rotating portion 52. Therefore, when unfolded, the folding chair of the present disclosure is stable and unchangeable in shape because of the first torsional resilient components 511, 521.

Referring to FIG. 1 through FIG. 4, in an embodiment, disposed between the other end of the left rear rotating portion 53 and the upper and lower parts of the rear side of the left support portion 11 and between the other end of the right rear rotating portion 54 and the upper and lower parts of the rear side of the right support portion 12 are second torsional resilient components 531, 541 (which is torsional springs) for exerting a downward moment of force on the pivotal connection point between the left rear rotating portion 53 and the right rear rotating portion 54. Therefore, when unfolded, the folding chair of the present disclosure is stable and unchangeable in shape because of the second torsional resilient components 531, 541.

Referring to FIG. 1 and FIG. 2, in an embodiment, a left front leg pad 111 is disposed on the front of the bottom of the left support portion 11, a right front leg pad 121 is disposed on the front of the bottom of the right support portion 12, a left rear leg pad 112 is disposed on the rear of the bottom of the left support portion 11, and a right rear leg pad 122 is disposed on the rear of the bottom of the right support portion 12. The left front leg pad 111, the left rear leg pad 112, the right front leg pad 121 and the right rear leg pad 122 are each made of a resilient plastic. Therefore, when unfolded, the folding chair of the present disclosure is firmly disposed on the ground, whereas the left support portion 11 and the right support portion 12 are prevented from scratching the ground directly, because of the left front leg pad 111, the left rear leg pad 112, the right front leg pad 121 and the right rear leg pad 122.

Referring to FIG. 1, FIG. 2, FIG. 11 through FIG. 13, in an embodiment, the left support portion 11, the right support portion 12, the left handrail portion 31 and the right handrail portion 32 are each U-shaped. A left front pivotal connection element 211 is disposed between the front end of the left support portion 11 and the front end of the left handrail portion 31. A left rear pivotal connection element 212 is disposed between the rear end of the left support portion 11 and the rear end of the left handrail portion 31. Two ends of the left handrail portion 31 are pivotally connected to a pivotal connection slot of the left front pivotal connection element 211 (not shown but similar to the pivotal connection slot 2121 of the left rear pivotal connection element 212) and the pivotal connection slot 2121 of the left rear pivotal connection element 212, respectively. The left load-bearing portion 21 is disposed between the left front pivotal connection element 211 and the left rear pivotal connection element 212. A right front pivotal connection element 221 is disposed between the front end of the right support portion 12 and the front end of the right handrail portion 32. A right rear pivotal connection element 222 is disposed between the rear end of the right support portion 12 and the rear end of the right handrail portion 32. Two ends of the right handrail portion 32 are pivotally connected to a pivotal connection slot of the right front pivotal connection element 221 (not shown but similar to the pivotal connection slot 2121 of the left rear pivotal connection element 212) and a pivotal connection slot of the right rear pivotal connection element 222 (not shown but similar to the pivotal connection slot 2121 of the left rear pivotal connection element 212), respectively. The right load-bearing portion 22 is disposed between the right front pivotal connection element 221 and the right rear pivotal connection element 222. Therefore, to fold up the folding chair of the present disclosure, the user can easily stack the left handrail portion 31 on the left support portion 11 and stack the right handrail portion 32 on the right support portion 12, because of the left front pivotal connection element 211, the left rear pivotal connection element 212, the right front pivotal connection element 221 and the right rear pivotal connection element 222.

Referring to FIG. 1, FIG. 2, FIG. 11 and FIG. 12, in an embodiment, the left back rest portion 41 has a left arcuate connecting rod 411 so as to be pivotally connected to the rear side of the upper part of the left handrail portion 31. The right back rest portion 42 has a right arcuate connecting rod 421 so as to be pivotally connected to the rear side of the upper part of the right handrail portion 32. Therefore, to fold up the folding chair of the present disclosure, the user can easily stack the left back rest portion 41 on the left handrail portion 31 and stack the right back rest portion 42 on the right handrail portion 32, because of the left arcuate connecting rod 411 and the right arcuate connecting rod 421.

Referring to FIG. 1 and FIG. 2, in an embodiment, the left engaging portion 71 and the right engaging portion 72 are each U-shaped. The lower part of the two ends of the left engaging portion 71 and the lower part of the two ends of the right engaging portion 72 are pivotally connected to each other at the pivotal connection point 73 to form an included angle greater than 180 degrees. The upper parts of the two ends of the left engaging portion 71 and the upper parts of the two ends of the right engaging portion 72 are close to each other, respectively. The central part between the two ends of the left engaging portion 71 and the central part between the two ends of the right engaging portion 72 are spaced apart from each other. Therefore, to fold up the folding chair of the present disclosure, the user can easily press the outer side of the left engaging portion 71 or the outer side of the right engaging portion 72, thereby allowing the folding chair to start to fold up.

Referring to FIG. 1, FIG. 2, FIG. 6 and FIG. 8, in an embodiment, the folding chair of the present disclosure further comprises a carrying portion 8. The carrying portion 8 has a carrying platform 83, at least a third torsional resilient component 81 (which is a torsional spring) and at least a connecting rod 82. The carrying platform 83 is pivotally connected to the right load-bearing portion 22 (or the left load-bearing portion 21). The third torsional resilient component 81 is disposed between the carrying platform 83 and the right load-bearing portion 22 (or the left load-bearing portion 21) to exert an upward moment of force on the carrying platform 83. The connecting rod 82 is connected between the carrying platform 83 and the right engaging portion 72 (or the left engaging portion 71). Therefore, after the folding chair of the present disclosure has been unfolded, the user can put an article on the carrying platform 83. To fold up the folding chair of the present disclosure, the user can make the carrying platform 83 accommodated inside the right support portion 12 (or inside the left support portion 11) because of the connecting rod 82.

Referring to FIG. 1 and FIG. 2, in an embodiment, the carrying platform 83 has a carrying recess 831 for holding a can or any other article.

Figure 7:
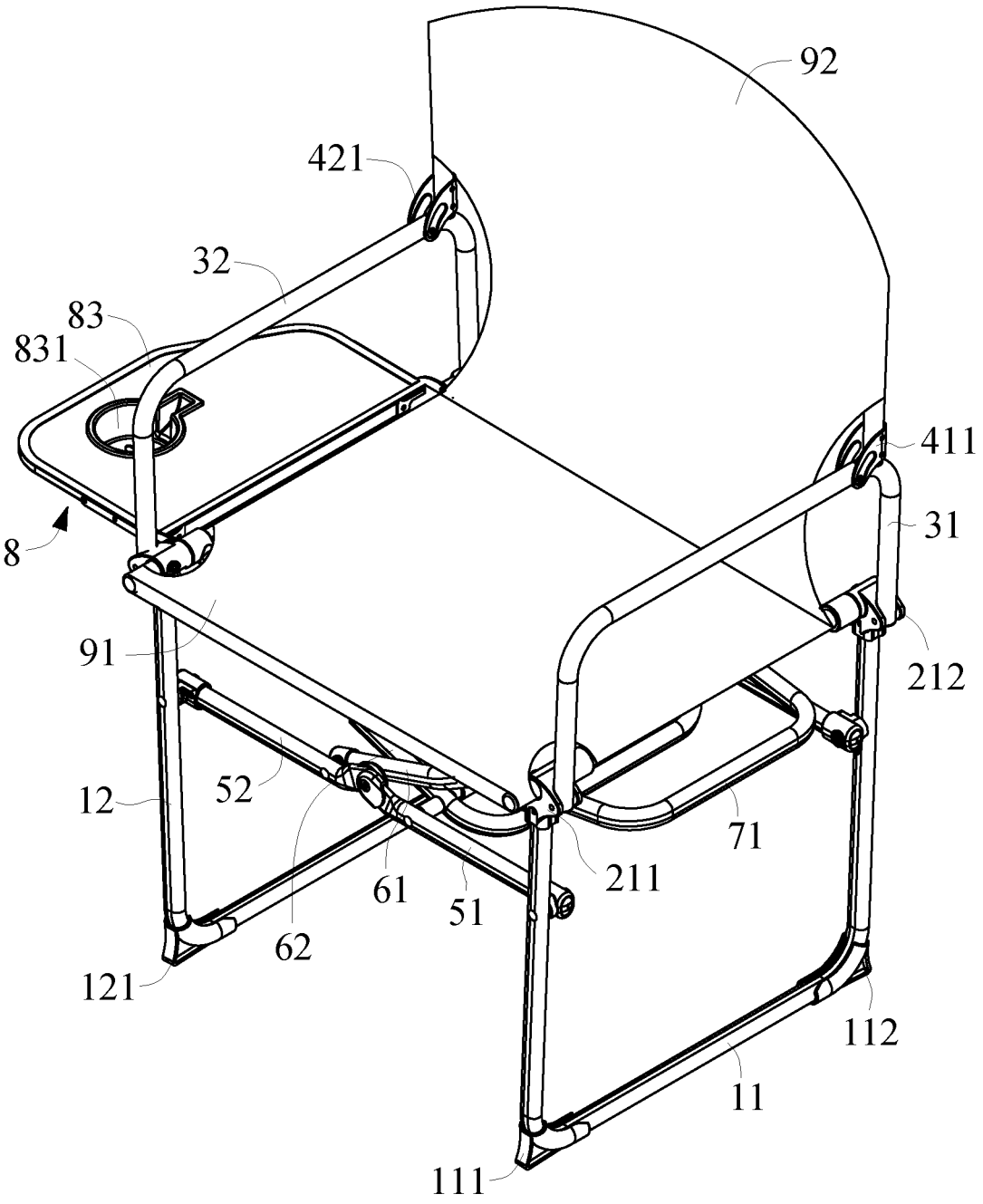
FIG. 7 is a schematic view of the folding chair, with the seat cushion portion and the back rest portion, unfolded according to a specific embodiment of the present disclosure.
Figure 8:
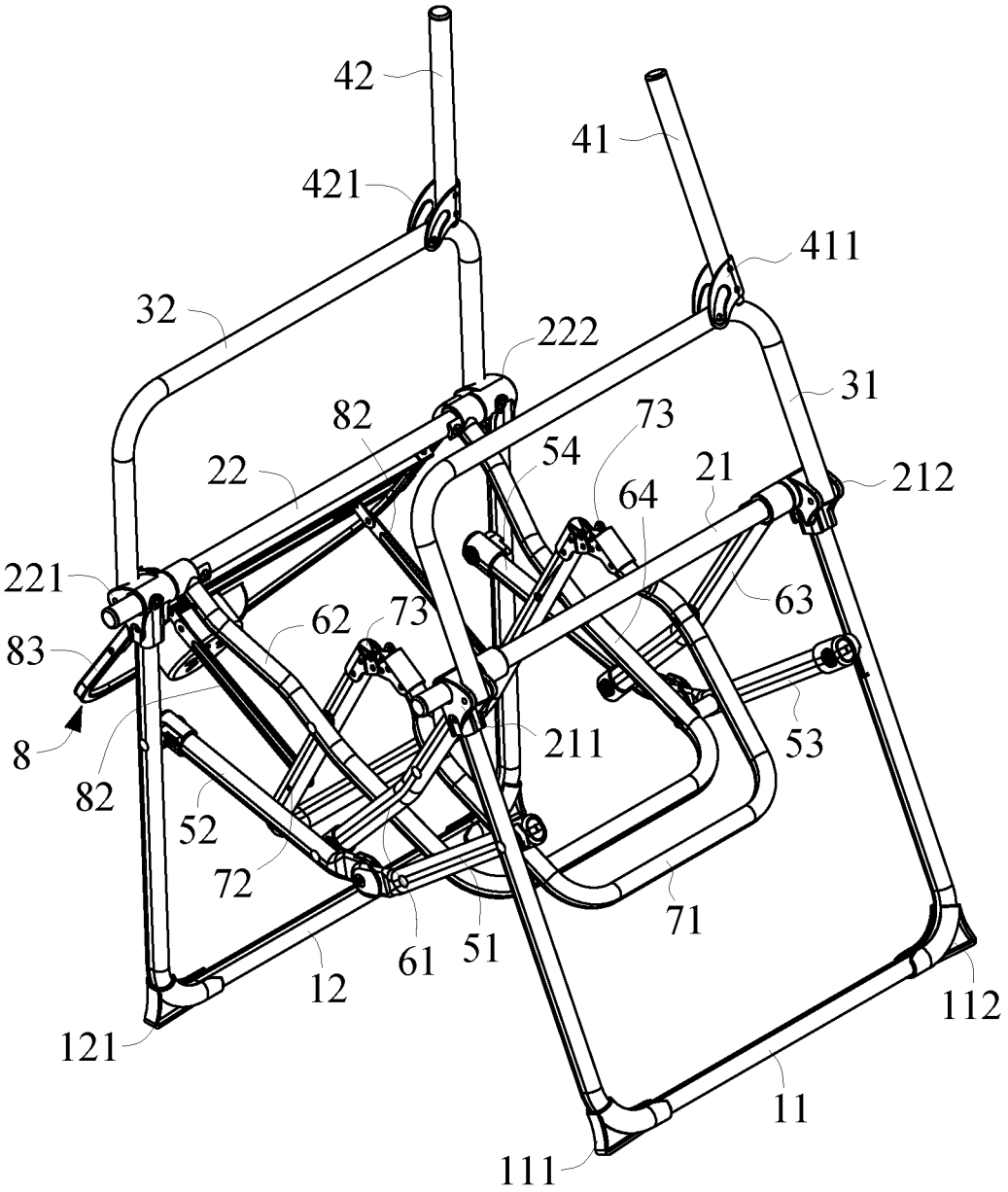
FIG. 8 is a schematic view 1 of the folding chair, without the seat cushion portion and the back rest portion, starting to fold up according to a specific embodiment of the present disclosure.
Figure 9:
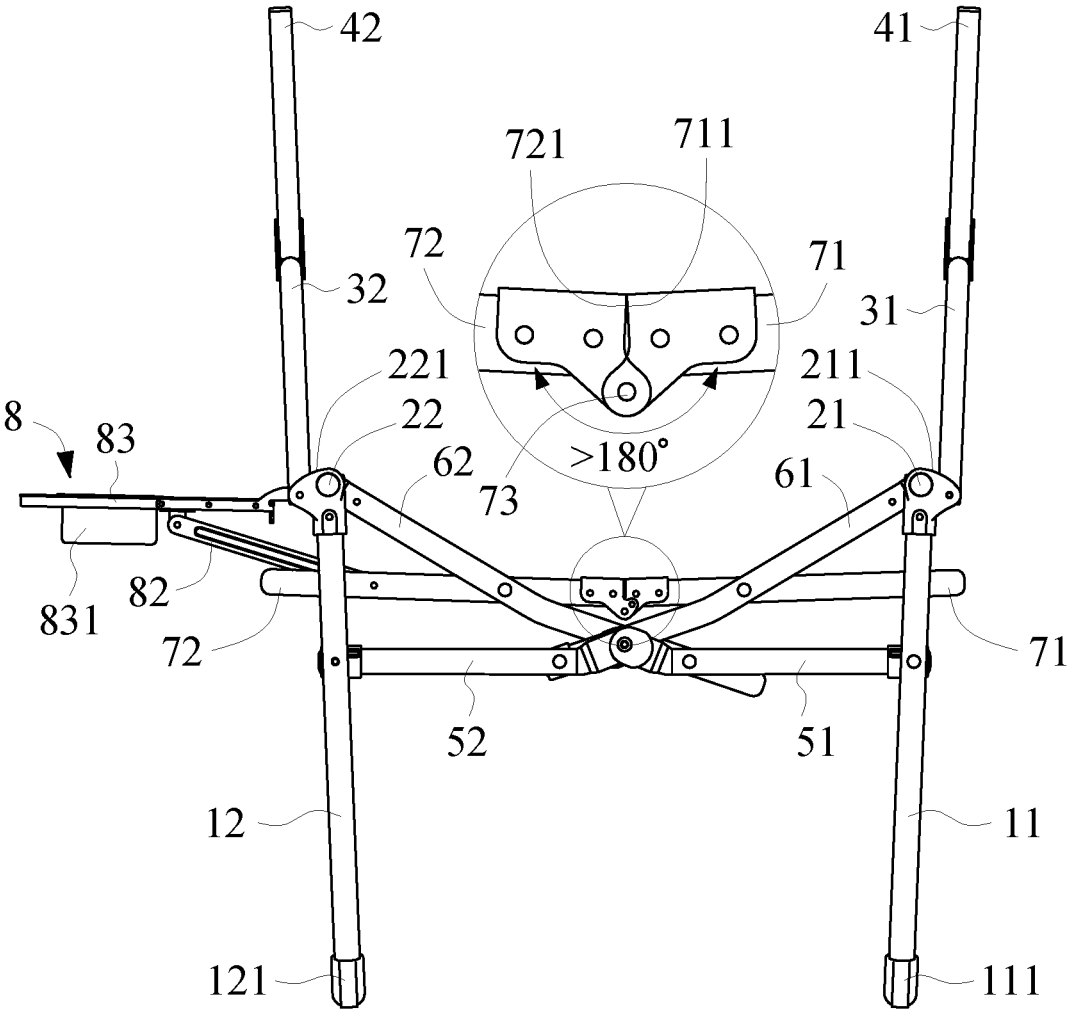
FIG. 9 is a front schematic view of the folding chair without the seat cushion portion and the back rest portion according to a specific embodiment of the present disclosure.
Figure 10:
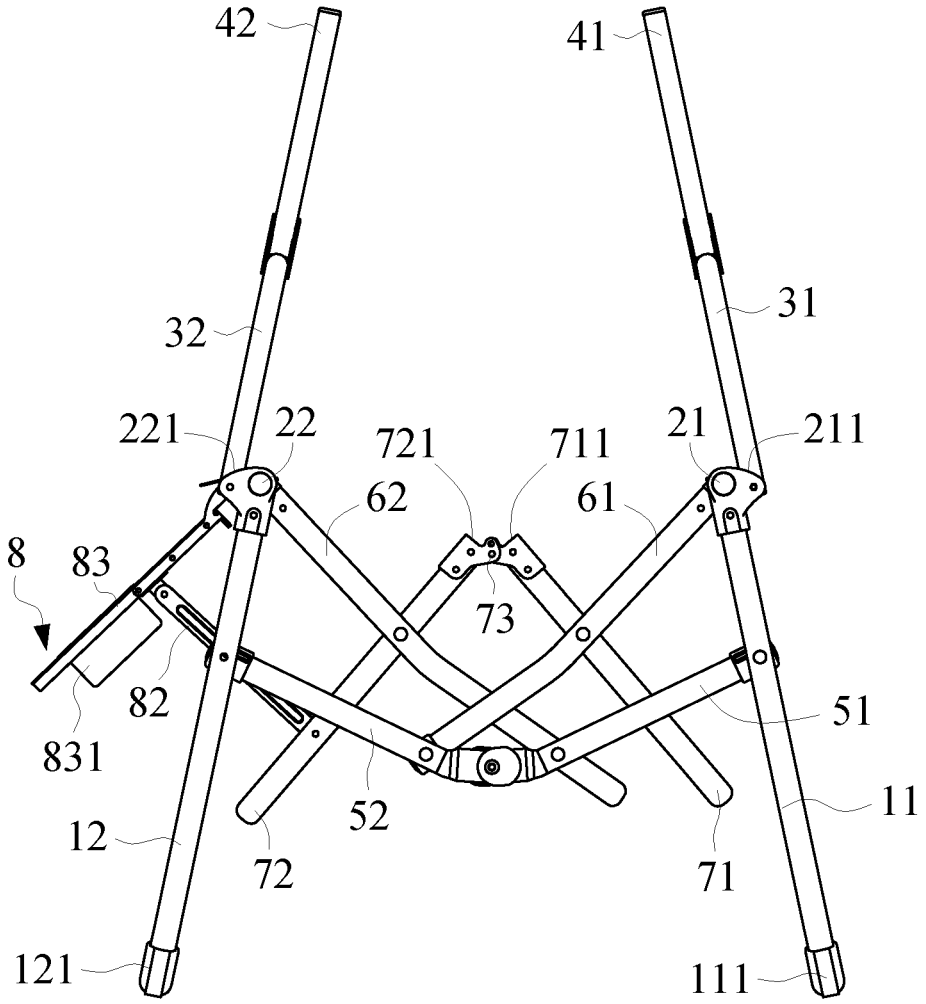
FIG. 10 is a schematic view 2 of the folding chair, without the seat cushion portion and the back rest portion, starting to fold up according to a specific embodiment of the present disclosure.
Figure 11:
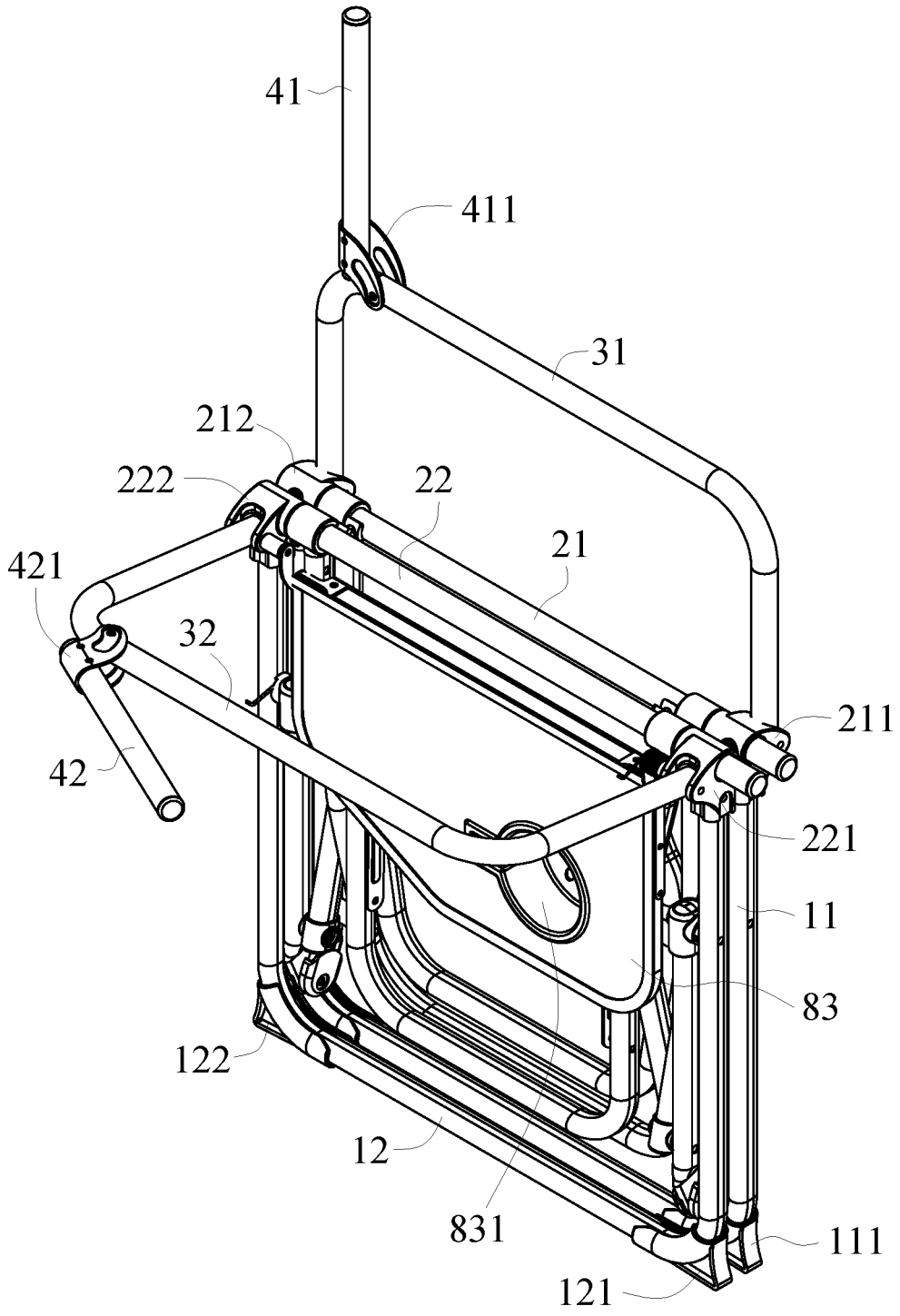
FIG. 11 is a schematic view of the folding chair, without the seat cushion portion and the back rest portion, with left and right handrail portions as well as left and right back rest portions stacked up according to a specific embodiment of the present disclosure.
Figure 12:
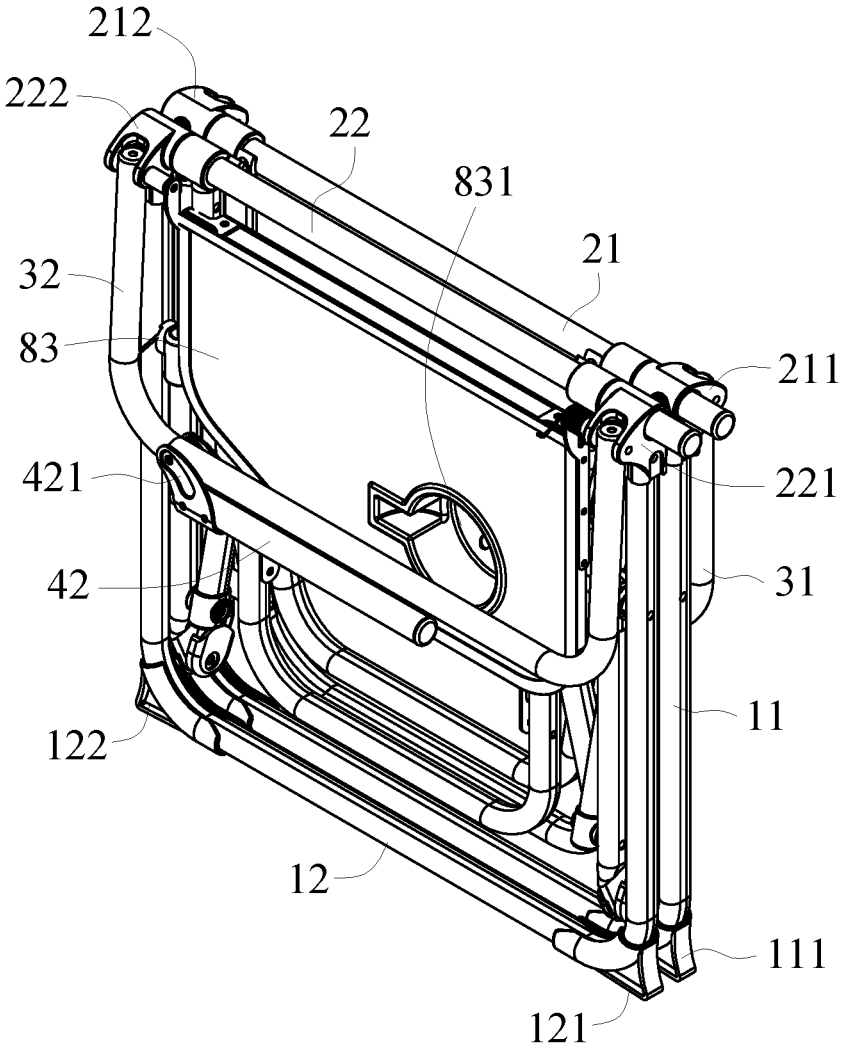
FIG. 12 is a schematic view of the folding chair, without the seat cushion portion and the back rest portion, fully folded up according to a specific embodiment of the present disclosure.
Figure 13:
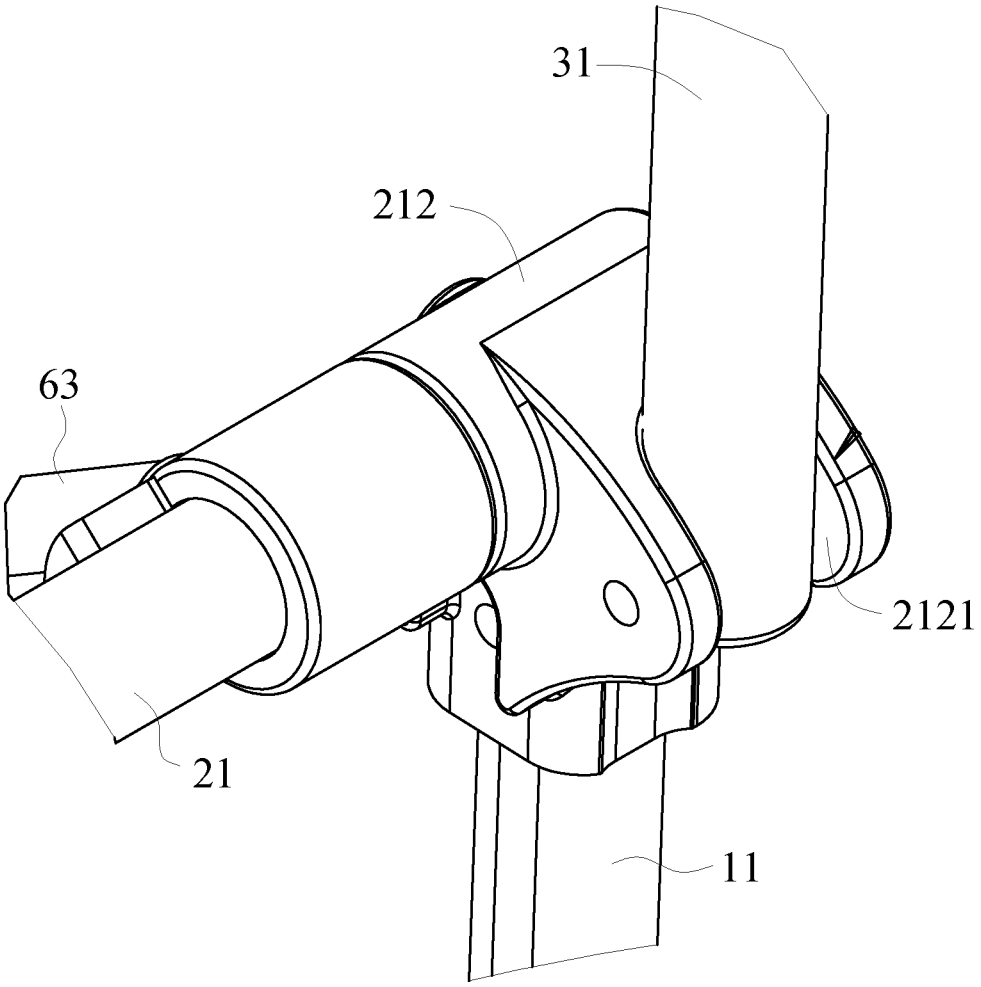
FIG. 13 is a schematic view of a left rear pivotal connection element of the folding chair according to a specific embodiment of the present disclosure.

Referring to FIG. 7, in an embodiment, the seat cushion portion 91 and the back rest portion 92 are connected to each other such that the seat cushion portion 91 and the back rest portion 92 are integrally formed.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A folding chair, comprising:

a left support portion, a right support portion, a left load-bearing portion, a right load-bearing portion, a left handrail portion, a right handrail portion, a left back rest portion, a right back rest portion, a left front rotating portion, a right front rotating portion, a left rear rotating portion, a right rear rotating portion, a left front cross portion, a right front cross portion, a left rear cross portion, a right rear cross portion, a left engaging portion, a right engaging portion, a seat cushion portion and a back rest portion;

wherein the left handrail portion is pivotally connected to the left support portion, with the left load-bearing portion disposed between the left handrail portion and the left support portion, the left back rest portion being pivotally connected to the left handrail portion, the right handrail portion being pivotally connected to the right support portion, the right load-bearing portion being disposed between the right handrail portion and the right support portion, the right back rest portion being pivotally connected to the right handrail portion, the left front rotating portion having an end pivotally connected to an end of the right front rotating portion, the left front rotating portion having another end pivotally connected to a front side of the left support portion, the right front rotating portion having another end pivotally connected to a front side of the right support portion, the left rear rotating portion having an end pivotally connected to an end of the right rear rotating portion, the left rear rotating portion having another end pivotally connected to a rear side of the left support portion, the right rear rotating portion having another end pivotally connected to a rear side of the right support portion, the left front cross portion having an end pivotally connected to the left load-bearing portion, the left front cross portion having another end pivotally connected to the right front rotating portion between the two ends of the right front rotating portion, the right front cross portion having an end pivotally connected to the right load-bearing portion, the right front cross portion having another end pivotally connected to the left front rotating portion between the two ends of the left front rotating portion, the left rear cross portion having an end pivotally connected to the left load-bearing portion, the left rear cross portion having another end pivotally connected to the right rear roatating portion between the two ends of the right rear rotating portion, the right rear cross portion having an end pivotally connected to the right load-bearing portion, the right rear cross portion having another end pivotally connected to the left rear rotating portion between the two ends of the left rear rotating portion, wherein a side of the left engaging portion and a side of the right engaging portion are pivotally connected to each other at a pivotal connection point to form an included angle greater than 180 degrees, wherein an upper part of the side of the left engaging portion and an upper part of the side of the right engaging portion are close to each other, the left engaging portion being pivotally connected to the left front cross portion between the two ends of the left front cross portion and to the left rear cross portion between the two ends of the left rear cross portion, the right engaging portion being pivotally connected to the right front cross portion between the two ends of the right front cross portion and to the right rear cross portion between the two ends of the right rear cross portion, the seat cushion portion being disposed between the left load-bearing portion and the right load-bearing portion, the back rest portion being disposed between the left back rest portion and the right back rest portion.

2. The folding chair of claim 1, wherein disposed between the other end of the left front rotating portion and a front side of the left support portion and between the other end of the right front rotating portion and a front side of the right support portion are two first torsional resilient components, respectively, to exert a downward moment of force on the pivotal connection point between the left front rotating portion and the right front rotating portion.

3. The folding chair of claim 1, wherein disposed between the other end of the left rear rotating portion and a rear side of the left support portion and between the other end of the right rear rotating portion and a rear side of the right support portion are two second torsional resilient components, respectively, to exert a downward moment of force on the pivotal connection point between the left rear rotating portion and the right rear rotating portion.

4. The folding chair of claim 1, wherein a left front leg pad is disposed on a front of a bottom of the left support portion, a right front leg pad is disposed on a front of a bottom of the right support portion, a left rear leg pad is disposed on a rear of a bottom of the left support portion, and a right rear leg pad is disposed on a rear of a bottom of the right support portion.

5. The folding chair of claim 1, wherein the left support portion, the right support portion, the left handrail portion and the right handrail portion are each U-shaped, a left front pivotal connection element is disposed between a front end of the left support portion and a front end of the left handrail portion, a left rear pivotal connection element is disposed between a rear end of the left support portion and a rear end of the left handrail portion, two ends of the left handrail portion are pivotally connected to a pivotal connection slot of the left front pivotal connection element and a pivotal connection slot of the left rear pivotal connection element, respectively, the left load-bearing portion is disposed between the left front pivotal connection element and the left rear pivotal connection element, a right front pivotal connection element is disposed between a front end of the right support portion and a front end of the right handrail portion, a right rear pivotal connection element is disposed between a rear end of the right support portion and a rear end of the right handrail portion, two ends of the right handrail portion are pivotally connected to a pivotal connection slot of the right front pivotal connection element and a pivotal connection slot of the right rear pivotal connection element, respectively, and the right load-bearing portion is disposed between the right front pivotal connection element and the right rear pivotal connection element.

6. The folding chair of claim 1, wherein the left back rest portion has a left arcuate connecting rod so as to be pivotally connected to the rear side of the left handrail portion, and the right back rest portion has a right arcuate connecting rod so as to be pivotally connected to the rear side of the right handrail portion.

7. The folding chair of claim 1, wherein the left engaging portion and the right engaging portion are each U-shaped, lower parts of two ends of the left engaging portion and lower parts of two ends of the right engaging portion are pivotally connected to each other, respectively, at the pivotal connection point to form the included angle greater than 180 degrees, the upper parts include upper parts of two ends of the left engaging portion and upper parts of two ends of the right engaging portion, which are close to each other, respectively.

8. The folding chair of claim 1, further comprising a carrying portion, the carrying portion having a carrying platform, at least a third torsional resilient component and at least a connecting rod, the carrying platform being pivotally connected to the right load-bearing portion, the third torsional resilient component being disposed between the carrying platform and the right load-bearing portion to exert an upward moment of force on the carrying platform, and the connecting rod being connected to the carrying platform and the right engaging portion.

9. The folding chair of claim 8, wherein the carrying platform has a carrying recess.

10. The folding chair of claim 1, wherein the seat cushion portion and the back rest portion are connected.

* * * * *